United States Patent [19]

Conner

[11] 4,380,470

[45] Apr. 19, 1983

[54] DUCTILE TRANSPLUTONIUM METAL ALLOYS

[75] Inventor: William V. Conner, Boulder, Colo.

[73] Assignee: The United States of America as represented by the United States Department of Energy, Washington, D.C.

[21] Appl. No.: 310,248

[22] Filed: Oct. 9, 1981

[51] Int. Cl.[3] ..... C22C 28/00; C22C 43/00

[52] U.S. Cl. ..... 75/122.7; 420/416

[58] Field of Search ..... 75/122.5, 122.7, 152; 252/644

[56] References Cited

U.S. PATENT DOCUMENTS

| | | | |
|---|---|---|---|
| 2,809,887 | 10/1957 | Runnalls | 75/122.7 |
| 2,867,530 | 1/1959 | Coffinberry | 75/122.7 |
| 3,600,586 | 8/1971 | Barthelemy | 250/432 R |
| 3,787,321 | 1/1974 | Dahlen | 252/644 |

*Primary Examiner*—L. Dewayne Rutledge
*Assistant Examiner*—J. J. Zimmerman

[57] ABSTRACT

Alloys of Ce with transplutonium metals such as Am, Cm, Bk and Cf have properties making them highly suitable as sources of the transplutonium element, e.g., for use in radiation detector technology or as radiation sources. The alloys are ductile, homogeneous, easy to prepare and have a fairly high density.

14 Claims, No Drawings

DUCTILE TRANSPLUTONIUM METAL ALLOYS

The U.S. Government has rights in this invention pursuant to Contract No. DE-AC04-76DP03533 between the U.S. Department of Energy and Rockwell International.

BACKGROUND OF THE INVENTION

Various isotopes of actinide elements have been used for many years for the development of radiation detectors, e.g., used in the Lawrence Livermore National Laboratory Radiochemical Diagnostic Tracer Program. For example, americium-241 and curium-244 are extensively used.

The conventional method for fabrication of these isotopes into radiation detectors involves powder mixing techniques. Oxides of actinides such as americium-241 and curium-244 are mixed with aluminum metal powder and the mixture is then pressed into disks under high pressure. Although this technique has been used very successfully for many years at LLNL, there are disadvantageous limitations on the configuration and size of the shapes which can be produced using such powder techniques. Moreover, it is difficult to obtain uniform powder mixtures and dust is generated during the mixing operation.

In view of these disadvantages, the problem exists to provide new alloys for use in radiation detectors, as well as improved methods for their preparation. It has been particularly desired to have such an alloy, including those of americium and curium which can be cast or rolled into a wide range of sizes and shapes. Furthermore, it is particularly desired to have such an alloy which is ductile, homogeneous, easy to prepare and of a fairly high density. Similarly, it is desired to have such alloys for use as sources of the radioactive elements for other purposes.

Toward this end, several different alloy systems have recently been investigated, including: americium/lead, americium/aluminum/ and americium/uranium. However, none of these systems proved suitable. All were brittle, non-homogeneous, difficult to prepare, and/or of insufficient physical and/or chemical properties, e.g., of too low a density.

In addition, various known alloy systems of plutonium are inapplicable to the radiation detectors of the Tracer Program because of the interference of the radioactivity of plutonium with the underlying mechanism of the radiation detection using the actinide, typically transplutonium elements. Thus, such alloy systems and the technology related thereto are inapplicable, as are various other alloys of reactive metals. See, for example, U.S. Pat. Nos. 2,867,530; 2,809,887 and 3,600,586.

SUMMARY OF THE INVENTION

Accordingly, it is an object of this invention to provide new alloys which are suitable for use in radiation detectors for purposes such as those discussed above.

It is a further object of this invention to provide methods for preparing such alloys.

Upon further study of the specification and appended claims, further objects and advantages of this invention will become apparent to those skilled in the art.

These objects have been obtained by this invention by providing an alloy consisting essentially of 1 to 99 wt % of Ce and 99 to 1 wt % of a transplutonium element which is americium, curium berkelium or californium.

In another aspect, this invention relates to radiation detectors based on active cells containing a radioactive actinide element or composition wherein the radioactive actinide is provided as an alloy described above.

In yet another aspect, this invention relates to a method for preparing one of these alloys comprising comelting cerium metal and one of said transplutonium metals at a temperature which is above the melting point of cerium, below the melting point of the transplutonium metal and above the melting point of the alloy which is prepared. As a result, essentially no vaporization of the transplutonium metal occurs. This method is particularly advantageous in conjunction with americium which has a relatively high vapor pressure at its melting point.

In still another aspect, this invention relates to the preparation of the alloys of this invention involving a step wherein a melt of the alloy is held in a container whose surface in contact with the melt is lined with Fiberfrax®. The resultant alloys have an exceptionally high purity.

DETAILED DISCUSSION

The preferred transplutonium elements are americium and curium, especially americium. The preferred composition of the alloys of this invention is one in which the content of cerium is 95-50 wt %, preferably 90–75 wt % and the content of the transplutonium element is 5–50 wt %, preferably 10–25 wt %.

Any isotope of the transplutonium elements can be used. The preferred isotopes are: Am-241, Cm-244 as well as Cf-252, all of which are used extensively for various purposes.

The alloy samples can be made in any size, limited only by the equipment employed in production. Typically, alloy disks for use in the mentioned tracer program are ⅜ to 1 inch in diameter.

The resultant alloys satisfy all of the requirements mentioned above for use in the radiation detectors of the LLNL Tracer Program and are of particularly high homogeneity and ductility.

All of the alloys of this invention can be prepared in at least two ways, i.e., by comelting or by coreduction techniques.

In the comelting method, cerium metal and the transplutonium metal are heated under vacuum, e.g., about $1\times10^{-5}$ torr or lower. At higher pressures, undesirable oxidation can occur. The temperature of the melting step is above the melting point of cerium metal (795° C.), below the melting point of the transplutonium metal (e.g., 1176° C. for americium, and 1340±40° C. for curium) and above the melting point of the alloy which is prepared. In general, the range of such melting points is 850°–1100° C. The precise value can be obtained for the given alloy by routine preliminary experiments.

In general, the comelt is held at the selected temperature for 10–30 minutes. The time must be sufficiently long for the unmelted americium to diffuse and dissolve into the cerium and achieve a homogeneous melt. That this diffusion and dissolution is effective to produce alloys with the superior properties per this invention was unexpected. On the other hand, the melt cannot be kept at the temperature for too long a time since with increasing time, the probability of significant attack on the melt container surface will increase. In this regard, in a preferred embodiment of this invention, the holding time of the comelt will be 10–20 minutes and will be followed by a second melting step, i.e., a double casting procedure, at a lower temperature and a shorter hold time. This will provide excellent homogeneity. Suitable temperatures for the second casting are any above about 200° C. of the melting point of the alloy, e.g., any in the range of 850°-1100° C., in general, and suitable hold times are in the range of 10-20 minutes. In practice, this has been readily accomplished by heating fairly rapidly to the melting temperature, and then reducing the heating rate to allow sufficient time for the alloy to form homogeneously. Obviously, a large number of combinations of temperatures and times could be used successfully.

This double melting step (double casting technique) is also advantageous in conjunction with the second method of preparation discussed below, and is especially useful in conjunction with a final adjustment in the weight ratio of the cerium and transplutonium element in the finally desired alloy as discussed below.

The use of this procedure avoids temperatures above the melting point of transplutoniums such as americium which have high vapor pressures in their liquid state; use of such temperatures could result in significant vaporization and loss of the metal involved.

The physical orientation of the cerium and transplutonium metal is not critical to the success of this method. However, it is possible for cerium oxides to float on top of the melted cerium metal as melting ensues. It is, in turn, possible for americium to float on these oxides which, conceivably, could prevent dissolution into the cerium metal. Accordingly, in the preferred orientation, americium is placed alongside the cerium metal or sandwiched aside two cerium samples. It is also possible to place the cerium metal on top of the americium; it is less preferred to place the americium on top of the cerium but this will readily succeed as shown in the examples below.

Cerium metal is commercially available. Americium metal can be prepared using fully conventional equipment and procedures such as described in Conner, J. Less Common Metals, 34 (1974) 301-308, which disclosure is incorporated by reference herein. Curium metal can also be prepared using fully conventional equipment and procedures, such as those described by Eubanks et al., *Inorg. Nucl. Chem. Ltrs.*, 5 (1969) 187-199, which is also incorporated by reference herein. The other metals can be prepared based on the principles disclosed in these references and others relating to the particular metals, using fully conventional considerations in analogy to known procedures.

The manner in which the alloy is cooled from the melt temperature is not critical.

The second method for preparing the alloys of this invention involves a coreduction of the fluorides of each component using calcium metal. In each case, the tetrafluorides are used. The reactions are illustrated below in terms of the americium alloys. First, the tetrafluorides can be prepared from the oxides as follows:

$$CeO_2+2F_2 \rightarrow CeF_4+O_2$$

$$AmO_2+2F_2 \rightarrow AmF_4+O_2$$

The tetrafluorides are then coreduced with calcium metal according to the following:

$$CeF_4+2Ca^{\circ} \rightarrow Ce+2CaF_2$$

$$AmF_4+2Ca^{\circ} \rightarrow Am+2CaF_2$$

In carrying out the coreduction, the temperature of the actual reaction is not critical. In general, the furnace temperature is increased up to a temperature at which the reaction initiates. The heat of reaction then maintains the reaction to essential completion. In general, the furnace is heated at a rate such that the reaction ensues 5 to 10 minutes after heating has begun. However, this is not critical. Similarly, the time of the reaction is not critical and is simply determined by the time it takes the reaction system to cool once the reaction has ceased. In general, after reaction initiation temperatures are reached, the furnace is turned off 2-5 minutes later. Prior to the commencement of the reaction, the reaction chamber is conventionally evacuated and backfilled with an inert gas such as argon. The operation is generally repeated several times. As for the first discussed preparation process, the rate of cooling the formed alloy is not critical.

The reactants are layered, as is conventional for this type of reaction; the design is conventional to avoid preignition of the reactants. Typical layering schemes are described in the Examples. In essence, it is necessary to keep the iodine and calcium away from the reactive fluoride. This is achieved in part by incorporation of calcium chloride in the reactant mixture. The calcium chloride is also believed to melt during the early stages thereby forming a molten salt cap over the rest of the melt which advantageously suppresses evaporation of the transplutonium element where that is a problem, for example, in connection with americium.

In general, in conducting the reaction, an excess of calcium is employed, e.g., a 25-35% excess based on the total moles of both fluorides. The amount of calcium chloride is generally 0.1 to 0.3, preferably, 0.18-0.28 moles per mole of cerium and transplutonium fluorides. The amount of iodine is not critical but is sufficient to off-set the heat transfer between the reactant mixture and the container wall. The smaller the amount of reactant, the larger the amount of iodine that will be used and vice versa. Typically, 0.1-0.5 moles of iodine per mole of cerium and transplutonium fluorides will be used. The iodine also functions by lowering the melting point of the slag by forming a eutectic with calcium fluoride.

The starting material oxides are readily available or preparable. Cerium oxide is commercially available from several sources. Americium oxide is also available from Oakridge National Laboratories. All of the fluorides can be readily prepared using fully conventional methods as exemplified and discussed in the examples below for the cerium and americium fluorides. For example, routine considerations can be employed for the preparation of any given metal fluoride in extrapulating from the procedures of Conner, J., Less Common Metals, 25 (1971) 379, whose disclosure is incorporated by reference herein.

As mentioned, both of these methods are operable with all of the alloys of this invention. The comelting method is somewhat limited since at lower cerium contents, there may be insufficient cerium to dissolve the americium, practically, at about 50% Ce problems ensue; preferably there is at least 25% Ce. In essence, at low Ce contents, in the comelting process, the melted cerium is dissolved into the americium; this will require the use of reaction temperatures higher than those mentioned above, and will require measures to suppress vaporization of the transplutonium element where that is a problem, e.g., using an inert gas atmosphere.

There is no corresponding limitation in the coreductiontechnique. The latter is the preferred method for preparing curium-containing alloys and those of other transplutonium elements which are difficult to prepare in the pure metal state. In addition, the coreduction technique is preferred where the melting point of the metal is relatively high.

As mentioned above, it is preferred in all cases that a second casting of the prepared alloy be employed in order to assure high homogeneity and avoid impurities introduced by longer durations at higher temperatures.

For either preparative technique, it is preferred that the amount of transplutonium element employed in conjunction with a given amount of cerium be somewhat larger than that desired in the final alloy. The precise amountof cerium needed can then be added during the second stage of the double casting process. In this way, wasting of the more expensive and difficult to obtain transplutonium elements is minimized. In general, the excess of transplutonium element is 5–10 wt %.

The starting materials used in both methods should be as pure as possible, as would be expected. For the coreduction process, the best results are obtained when the transplutonium oxide and cerium oxide feed materials are produced by calcination of corresponding, high purity oxalates, for example, at appropriate temperatures, e.g., for cerium and americium oxalates, a temperature of 600°–625° C.

For the comelting process, the best results can be obtained when the cerium and transplutonium feed metals are free of inclusions. For example, excellent results were achieved when the cerium metal used in the process of this invention was prepared from high purity cerium oxalate calcined at 625° C. for 6 hours. The resulting cerium oxide was converted to the metal and then cast into a feed ingot before being alloyed. The metal yield for the resultant cast alloy was 87.9% (see casting no. 2 of Table III below), as compared with metal yields of 67–74% using inferior cerium metals.

For both processes, any container which is inert to the reaction can be employed. As shown in the Examples, several possibilities exist, including $ZrO_2$ containers. The preferred container is one whose surface in contact with the melt is lined with Fiberfrax ® which is a trademark of Carborundum Company. This is a composition of alumina and silica. It has been employed generally in the form of a cement additionally containing adhesion effective amounts of milled fiber and an inorganic binder. Alloys prepared in such containers are particularly pure as shown in the Examples.

Purity is not particularly critical for most uses of the alloys of this invention since the radiation emitted is the main feature. For example, for the tracer disk application, impurity contents of 1–2 wt % are easily tolerated. Such impurity tolerances are easily achieved by this invention.

The fabrication of tracer disks from the alloys of this invention can be carried out using conventional techniques and considerations. Various methods are exemplified below. Similarly, all other details involving the use of the alloys of this invention in the radiation detectors in the LLNL Tracer Disk program discussed above are fully conventional.

All of the alloys of this invention can also be used fully conventionally as sources of the radiation emitted by the particular transplutonium isotope contained. Where a spectrum of radiation is desired, an alloy containing a mixture of transplutonium elements can be used. Such radiation sources can be used in essentially the same fashion as any other radiation source, but the advantageous properties mentioned above will make them preferred for many applications in fields such as medical uses, detection technology, experimental spectroscopic diagnostics, etc.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever. In the following examples, all temperatures are set forth uncorrected in degrees Celsius; unless otherwise indicated, all parts and percentages are by weight.

EXAMPLE 1

Americium-cerium alloys were prepared using both comelting and coreduction techniques. Americium for both experiments was prepared from one batch of $AmO_2$. This $AmO_2$ contained 5550 ppm total of detectable impurities and the americium content of the oxide was 0.865 g of Am per g of oxide. The 22.0 g batch of $AmO_2$ contained 19 g of americium-241. This $AmO_2$ was converted to $AmF_4$ by first heating the oxide at 600° C. for four hours in air to remove any moisture. The calcined oxide was contacted with $F_2$ gas to convert the $AmO_2$ to $AmF_4$. Equipment and procedures were as described by Conner, J. Less Common Metals, 25 (1971) 379. A 12.9 g portion of this $AmF_4$ containing 10 g of americium was converted to americium metal for use in the first comelting experiment.

The $AmF_4$ was reduced to metal using a reduction charge which contained one mole of $I_2$ per mole of Am, a 30% excess of calcium and 0.4 moles of $CaCl_2$ per mole of Am. This reduction was also accomplished using equipment and procedures which are fully conventional and described in Conner, J. Less Common Metals, 34 (1974) 301–308. The reduction produced a 7.9 g button for a 79% metal yield. A comelted cerium-americium alloy was prepared using the 7.9 g americium metal button and 32 g of 99.9% pure cerium metal obtained from Research Chemical Corporation. A $ZrO_2$ coated graphite melting crucible was used to hold the metals. The melting crucible was placed in the induction coil of a vacuum casting furnace and the cerium metal was placed in the button of the crucible. The americium metal was placed on top of and in contact with the cerium metal. A $ZrO_2$ coated ingot mold was placed in a resistance heated mold heater and the vacuum chamber was sealed and evacuated to $1\times10^{-4}$ torr. The melting crucible was heated to 1050° C. over a 20 minute period and the molten alloy was poured into the ingot mold which had been heated to 750° C. This casting produced a 2½ by 1¼ by 0.060 inch thick ingot which weighed 27.2 g. The ingot was soft and ductile and could be cut with wire cutters. Samples from six different locations on the ingot were analyzed for americium content. The americium content of these samples varied from 0.203 to 0.213 g Am per g of alloy, which showed the americium content of the alloy to be homogeneous. A coreduced cerium-americium alloy was prepared using the remaining 11.6 g of $AmF_4$. This was coreduced with 46.9 g of $CeF_4$ using a reduction charge containing 0.5 moles of $I_2$ per mole of Am plus Ce, a 30% excess of calcium and 0.2 moles of $CaCl_2$ per mole of Am+Ce. This charge was loaded in a conventional reaction vessel. The reduction charge reacted after 10 minutes of heating at 950° C. in a vertical crucible furnace and produced a 39 g button. A metal yield of 97.5% and an americium yield of 94.8% were obtained from this reduction. The metal button was cast into a 2½ by 1¼ by ⅛ inch thick ingot mold using the equipment and procedure described above. Analysis of samples from this ingot gave an americium content of 0.219±0.006 g Am per g of alloy.

Metallographic examination of these alloys revealed a homogeneous structure. Scanning electron microscope (SEM) analysis of these alloys showed a cerium-americium, alloy matrix which contained inclusions of cerium metal. The matrix contained cerium and americium in the ratio of three atoms of cerium to one atom of americium. Differential thermal analyses (DTA) were performed on pure cerium metal, samples of the comelted and coreduced alloys, and samples of the coreduced alloy which had been diluted with cerium metal to reduce the americium content to 17.5 and 11.8 weight percent. Results of the DTA analysis, on the coreduced alloys are shown in Table 1. As can be seen, the phase transition and melting temperatures increase with increasing americium content.

TABLE I

| Description of Sample | Results of DTA Analyses: Americium Content of Sample, Weight % | Americium Content of Sample, Atom % | Phase Transition Temperature °C. | Melting Temperature °C. |
|---|---|---|---|---|
| Ce—Am Alloy | 21.9 | 14.0 | 800–820 | 830–840 |
| Ce—Am Alloy | 17.5 | 11.0 | 790–810 | 817–827 |
| Ce—Am Alloy | 11.8 | 7.2 | 760–780 | 800–820 |
| Pure Cerium | 0 | 0 | 726 | 795 |

EXAMPLE 2

An alloy containing 30 wt % of americium and 70 wt % of cerium was desired. Initial alloy formation was accomplished by coreducing cerium tetrafluoride ($CeF_4$) and americium tetrafluoride ($AmF_4$) with calcium metal using the equipment and procedures of Example 1. Metal buttons from two coreductions were used as feed for this casting. Charge compositions used for these coreductions and the metal yields obtained are given in Table II. Casting of these buttons into ingot form was accomplished using the equipment and procedures described in Example 1. The ingot mold was heated to 845° C. The melting crucible was heated from 25 to 850° C. over a 7 minute period. The heating rate was then reduced, and the crucible containing the alloy buttons was heated from 850° to 1050° C. over a period of 15 minutes. The molten alloy was then bottom poured into the heated mold. This casting produced a 131.8 g ingot which contained 29.6±0.2 wt % Am. The charge and yield data for this casting (No. 1) are given in Table III.

TABLE II

Cerium-americium Coreduction Data

| Reduction No. | Reduction Charge Data: $AmF_4$ Wt. g | Wt. Am In $AmF_4$, g | $CeF_4$ Wt. g | Wt. Ce In $CeF_4$, g | % Excess Ca | Moles $I_2$ / Mole Ce + Am | Moles $CaCl_2$ / Mole Ce + Am |
|---|---|---|---|---|---|---|---|
| 1 | 34.25 | 26 | 114 | 75 | 30 | 0.35 | 0.2 |
| 2 | 34.7 | 25.9 | 115.6 | 75.8 | 30 | 0.35 | 0.2 |

| Reduction No. | Reduction Yield Data: Button Wt. g | Overall Yield, % | Wt. Am In button, g | Am Yield, % | Wt. Ce in Button, g | Ce Yield % |
|---|---|---|---|---|---|---|
| 1 | 70.5 | 69.8 | 24.17 | 93 | 46.33 | 61.8* |
| 2 | 95.9 | 94.3 | 24.26 | 93.8 | 71.64 | 94.5 |

*This low cerium yield resulted from using unreactive $CeO_2$ to prepare the $CeF_4$ used for this coreduction. The $CeO_2$ had been calcined at a high temperature (~800° C.) and it was later determined that high temperature calcination produced unreactive oxides.

EXAMPLE 3

An alloy containing 20 wt % of americium and 80 wt % of cerium was desired. This alloy was prepared using the comelting technique. the americium and cerium metal were loaded int the melting crucible with the americium between two pieces of cerium metal. The ingot mold was heated to 820° C. The melting crucible was heated to 830° C. over a period of 11 minutes and then the temperature was increased to 1050° C. in 7 minutes. The temperature was then decreased to 1000° C. and the alloy was bottom poured into the ingot mold. This casting produced a 188.3 g ingot which was 20±0.7 wt % americium. The charge and yield data for this casting (No. 2) are given in Table III.

TABLE III

Casting Charge and Yield Data

| Casting No. | Metal Charge Wt. g | Wt. of Ce in Charge, g | Wt. of Am in Charge, g | Ingot Wt. g | Metal Casting Yield, % | Am Content of Ingot, % |
|---|---|---|---|---|---|---|
| 1 | 166.4 | 117.9 | 48.4 | 131.8 | 79.2 | 29.6 ± 0.2 |
| 2 | 214.1 | 165.4 | 48.7 | 188.3 | 87.9 | 20.0 ± 0.7 |

EXAMPLE 4

Comelted alloys were prepared using two different vacuum casting furnaces. (These furnaces were also used in the foregoing examples.) One furnace was a System VII general purpose metallurgical facility manufactured by Vacuum Industries. This furnace consists of a tilt-pouring, four inch diameter by six inch high water cooled induction coil enclosed in a water cooled vacuum chamber. The coil contains a quartz insulator sleeve and a one-fourth inch thick sleeve of WDF graphite felt insulation manufactured by Union Carbide. Power for the coil is supplied by an Inductotherm fifteen KW motor generator unit. The mold heater is a three KW resistance type unit fabricated at Rockwell International, Rocky Flats, Col. Temperature measurements were obtained with either chromel-alumel, or platinum-rhodium thermocouples, or an optical pyrometer, depending upon the temperature range involved.

The vacuum system consisted of a N.R.C. Model NHS-4-750 four inch diffusion pump with a Welch Model 1397B mechanical roughing pump.

The second furnace was preferred. It was a bottom pouring type furnace, but the coil dimensions, insulation and power supply were the same as those used for the furnace described above. The mold heaters for the two furnaces were interchangeable, and temperatures were measured using the equipment described above. A Heraeus Model WS-250 blower and a Welch Model 1398M mechanical pump were used as the roughing system for the chamber. Final chamber vacuums were achieved using a six inch N.R.L. Model UHS-6 diffusion pump with a Welch Model 1402 mechanical holding pump.

All of the comelted alloys were prepared by heating a melting crucible containing americium metal and the solvent metal to a temperature above the melting point of the solvent metal, but below the melting point of americium. The melting crucible was held at temperature for a period of time sufficient to allow the americium to dissolve in the solvent metal. The alloy was then poured into a mold held at or below the melting point of the alloy.

Coreduced alloys were prepared by reducing a mixture of americium tetrafluoride ($AmF_4$) and a fluoride of the solvent metal with calcium metal in a sealed reaction vessel. Thermite or "bomb" reduction techniques have been described extensively in the literature and were used here. The equipment and procedures used for preparing and reducing $AmF_4$ were those of the references cited above.

Cerium tetrafluoride ($CeF_4$) was prepared by reacting cerium oxide ($CeO_2$) with fluorine ($F_2$) gas using the same equipment and procedures used to prepare $AmF_4$. The charges used for cerium-americium coreductions contained a 30% excess of calcium, 0.35 to 0.5 moles of iodine per mole of cerium plus americium and 0.2 moles of $CaCl_2$ per mole of cerium plus americium. The charges were loaded in a series of layers using an arrangement conventional in thermit reduction work. The bottom layer was a mixture of calcium and iodine containing 10 wt % of the total iodine used in the charge, plus a 30 mole % excess of calcium. The next layer contained the $CeF_4$ mixed with calcium and iodine. The $AmF_4$ was mixed with a 30 mole % excess of calcium and this mixture was placed in the middle of the layer containing the $CeF_4$. The $CaCl_2$ was added next followed by a layer of calcium and iodine containing the same quantity of calcium and iodine as the bottom layer.

After the reduction charge had been placed in the crucible, the pressure vessel was sealed using a flat copper gasket and was purged by alternately evacuating and filling with argon gas. The purge valve was closed and the vessel was heated until the charge reacted, as determined by a decrease in the neutron flux. When the vessel had cooled, the metal button was removed, pickled in distilled water and weighed.

Alloys of these two metals were easily prepared using both comelting and coreduction techniques. Comelted alloys containing from 10 to 30 wt % americium were formed by heating the two metals to a temperature of 200° C. above the melting temperature of the alloy and holding the melt above the melting temperature for 10 to 15 minutes. Coreduced alloys have been prepared containing 1 to 34 wt % americium using reduction charges containing 50 or 100 g of americium plus cerium.

EXAMPLE 5

Alloy Properties

Alloy characterization studies were conducted to determine some of the properties of cerium-americium alloys. For purposed of comparison, some of the properties of pure cerium metal are given in Table IV. Cerium metal has a face centered cubic (FCC) structure at room temperature and a body centered cubic structure (BCC) above 725° C. Cerium metal has a density of 6.771 g/Cm$^3$ at room temperature and the pure metal melts at 795° C.

TABLE IV

SOME PROPERTIES OF PURE CERIUM METAL

| | | Melting Temperature 795° C. Boiling Temperature 3468° C. | | | |
|---|---|---|---|---|---|
| | | Lattace Constants A | | Transition Temperature | Density |
| Phase | Type | $a_o$ | $c_o$ | °C. | g/Cm$^3$ |
| α | Face Centered Cubic | 4.85 | | −196 | 8.23 |
| β | Hexagonal Close Packed | 3.68 | 11.92 | −73 | 6.66 |
| γ | Face Centered Cubic | 5.16 | | 725 | 6.771 |
| δ | Body Centered Cubic | 4.11 | | | 6.67 |

Differential thermal analyses (DTA) performed on samples of comelted and coreduced alloys showed that the phase transition and melting temperatures increased with increasing americium content (see Table I above). The density of cast cerium-americium alloy ingots was determined using an immersion technique. Results of the density determinations for 10 and 20 weight % americium alloys are given in Table V. These results show that the density increased with increasing americium content.

TABLE V

DENSITY OF CERIUM-AMERICIUM ALLOYS

| Americium Content of Sample, wt % | Sample Weight g | Sample Size | Density g/Cm$^3$ |
|---|---|---|---|
| 10.5 + 0.4 − 0.3 | 69.85 | 2½ × 1¾ × ¼ | 7.183 |
| 21.08 + 0.34 − 0.36 | 10.27 | 1¼ × 1¼ × 0.060 | 7.649 |

Pure cerium metal has a density of 6.771 g/Cm$^3$ and the 10 wt % americium alloy had a density of 7.183 g/Cm$^3$. The 20 wt % americium alloy had a density of 7.649 g/Cm$^3$.

Hardness measurements taken on pure cerium metal and cerium-americium alloy samples showed that the hardness also increased with increasing americium content. The results of diamond pyramid hardness (DPH) measurements taken on as cast cerium and cerium-americium alloy samples are given in Table VI.

TABLE VI

HARDNESS OF CERIUM-AMERICIUM ALLOYS

| Americium | Hardness, DpH | | |
|---|---|---|---|
| Content of Sample, wt % | Average Reading | Low Reading | High Reading |
| 0 | 34.64 | 26 | 47 |
| 10.5 + 0.4 − 0.3 + 0.5 | 38.2 | 36.5 | 40 |

TABLE VI-continued

| HARDNESS OF CERIUM-AMERICIUM ALLOYS | | | |
|---|---|---|---|
| Americium | Hardness, DpH | | |
| Content of Sample, wt % | Average Reading | Low Reading | High Reading |
| 20.8 − 0.5 + 0.2 | 52.25 | 45 | 70 |
| 20.2 − 0.4 | 59 | 56.5 | 63.5 |

The average DPH for cerium metal was 34.6 and for 20 wt % americium alloys the average DPH values for two samples were 52 and 59. These values compare to a DPH of 45 for fully homogenized delta plutonium stabilized with 1 wt % gallium.

X-ray diffraction, metallographic and SEM studies have been performed on several cerium-americium alloy samples. The results of x-ray diffraction analyses of cerium-americium alloys are shown in Table VII. The results show a single phase system with a face centered cubic structure and a lattice constant of $a_o$=5.56 A.

TABLE VII

| RESULTS OF X-RAY DIFFRACTION ANALYSIS OF CERIUM-AMERICIUM ALLOYS | | |
|---|---|---|
| Americium Content of Sample, wt % | Space Lattice and Space Group | Lattice Constant A |
| + 0.4 | Cubic | |
| 10.5 − 0.3 | Fm 3m | $a_o = 5.56 \pm 0.03$ |
| + 0.5 | Cubic | |
| 20.8 − 0.5 | Fm 3m | $a_o = 5.54 \pm 0.01$ |
| + 0.2 | Cubic | |
| 20.2 − 0.4 | Fm 3m | $a_o = 5.56 \pm 0.03$ |

A photomicrograph of a sample of the pure cerium metal feed stock as received from Research Chemicals Corporation was taken and showed the grain structure of cerium metal and some oxide and carbide inclusions.

Photomicrographs were also taken of samples of cerium-americium alloys prepared per this invention. One sample contained 21 wt % of americium and was formed by heating cerium and americium metal to 1050° C. The melt was held above 850° C. for eight minutes prior to casting the alloy into a feed ingot. A differential interference contrast (DIC) method was used to take its photomicrograph which showed a structure very similar to the structure shown for pure cerium metal in a photomicrograph. The inclusions visible in the alloy photomicrograph were identified as cerium metal by SEM analysis. This indicated that the melt was cast before complete homogenization had occurred. Additional work with comelted alloys showed that double casting ensured completely homogenized alloys.

EXAMPLE 6

Double Casting

A cerium-americium alloy containing 20.2 wt % americium was prepared by first co-melting the two metals and then casting them into a feed ingot. This feed ingot was then recast into disks, and a sample was taken from the sprue which formed above the disks. A photomicrograph was taken. Analysis of the sample in the SEM was conducted using an energy dispersive x-ray spectrometer (EDS). The sample was analyzed for americium by point counting across individual grains. Analysis of several grains showed that the homogeneity of the americium was within the limit of error of this technique (±1%).

SEM analysis of this sample also revealed a number of inclusions at the grain bounderies and in the individual grains. Analysis of the sample using a wave length dispersive x-ray spectrometer (WDS) indicated that these inclusions were high in carbon. However, this sample had been etched using a 10 wt % citric acid solution and the grain boundaries had been almost totally etched out. A sample of cerium—10 wt % americium alloy was analyzed in the as-polished condition without the citric acid etch. This method of sample preparation eliminated etching of the grain boundaries and also eliminated any possible source of carbon contamination.

EXAMPLE 7

Crucible Effects

Analysis of 20 and 10 wt % americium alloy samples using a Leco carbon analyzer showed a carbon content of 1.25 and 2 wt % respectively. The high carbon content of these alloys did not affect their end use as tracer disks, but it did reveal a possibility for improving the procedure used to cast the alloys. The original castings were conducted using zirconium oxide ($ZrO_2$) coated graphite melting crucibles and molds. Graphite molds coated with $ZrO_2$ were satisfactory, but using $ZrO_2$ coated graphite melting crucibles caused some minor problems. At the higher temperatures required for the melting crucibles, $ZrO_2$ was attacked by the alloy.

A listing of potential crucible materials and coatings and their effects is given in Table VIII. Tantalum metal was wet by cerium, and TaO and TaC were both attacked by cerium. Cerium metal wet $Y_2O_3$ coatings and would flow up the sides of $Y_2O_3$ coated graphite crucibles. Cerium attacked $CaF_2$ coatings, but there was no visible attack on graphite crucibles coated with $ZrO_2$.

However, close analysis of samples from initial alloy castings revealed high carbon contents with $ZrO_2$; thus, an investigation was conducted to find a coating to replace $ZrO_2$.

TABLE VIII

| CRUCIBLE MATERIALS AND COATINGS TESTED | | |
|---|---|---|
| Crucible Material | Coating | Observation |
| Tantalum | None | Ta wet by cerium |
| Tantalum | $TaO_2$ | Coating attacked by cerium |
| Tantalum | TaC | Coating completely removed by cerium |
| Graphite | $Y_2O_3$ | Coating wet by cerium |
| Graphite | $CaF_2$ | Coating attacked by cerium |
| Graphite | $ZrO_2$ | No visible attack by cerium |

Materials and coatings tested are listed in Table IX. A coating composed of a mixture of calcium oxide (CaO) and calcium nitrate $CaNO_3$) protected tantalum metal, but graphite coated with this mixture was badly attacked by molten cerium metal. Fiberfrax® was purchased as a coating cement from the Carborundum Company and was diluted with water (1 vol. of Fiberfrax® to 3 volumes of water) before it was used. Fiberfrax® is composed of alumina and silica and the cement contains milled fiber with an inorganic binder. No attack was observed on either tantalum or graphite substrates which were coated with Fiberfrax®.

TABLE IX

CRUCIBLE MATERIALS AND COATINGS TESTED DURING SECOND INVESTIGATION

| Crucible Material | Coating | Observation |
|---|---|---|
| Tantalum | $CaO—CaNO_3$ | No visible attack by cerium |
| Tantalum | Fiberfrax® | No visible attack by cerium |
| Graphite | $CaO—CaNO_3$ | Coating attacked by Cerium |
| Graphite | Fiberfrax® | No visible attack |

Fiberfrax® - Registered Tradename of the Carborundum Company

Samples of both pure cerium metal and cerium-americium alloys cast using Fiberfrax® coated graphite were analyzed for aluminum, silicon and carbon. The results of these analyses are given in Table X. There was only a small amount of aluminum and silicon pick-up from the Fiberfrax® coating. There was no increase in carbon content in the cast cerium samples and the carbon content of the cerium-americium alloys was much lower than the carbon content of alloy samples prepared using $ZrO_2$ coatings.

EXAMPLE 8

Preparation of Tracer Disks for Radiation Detectors

Several different casting procedures have been used for casting cerium-americium alloys into tracer disks. The preferred procedure is described below.

TABLE X

RESULTS OF ANALYSES ON SAMPLES CAST USING FIBERFRAX COATED GRAPHITE

| Material Cast | Casting Temperature, °C. | Analysis, ppm Al | Si | C |
|---|---|---|---|---|
| Cerium | 930 | 171 | 64 | 487 |
| Cerium | 955 | 173 | 61 | 302 |
| Cerium* | 950 | 215 | 220 | 369 |
| Cerium - 10 wt % Americium | 980 | 250 | — | 1844 |
| Cerium - 10 wt % Americium | 960 | 92 | 56 | 2097 |
| Cerium - 25 wt % Americium | 1000 | 260 | 230 | 1073 |
| Cerium Metal Feed Stock Used For Castings | | 130 | 58 | 676 |

*Cerium metal prepared by reduction of $CeF_4$ with calcium metal.

A melting crucible and pull rod were used. The melting crucible was fabricated in two pieces to allow access to the bottom inner surfaces for spray coating with Fiberfrax®. A coating of Fiberfrax® was also applied to the pull rod. The mold design was developed to produce varying disks. It was a split mold with a center dividing plate. It permitted disk cavities to be machined into the faces of each half of the mold. Use of the center dividing plate made it possible to prepare eight disks in a single casting. This same basic mold design was used to prepare disks with a wide range of americium contents by varying the depth of the disk cavity and the americium content of the alloy. Disks have been prepared containing from 0.625 to 3.125 g of americium-241 per disk.

Disk weights and dimensions can be closely controlled as shown by the data given in Table XI. These eight disks contained 21.18 g of americium and the americium content of the alloy was $$21.9 \begin{smallmatrix} +0.2 \\ -0.5 \end{smallmatrix} \text{ wt \%.}$$

The average disk weight was 12.06615 g and the spread in disk weights varied from +1.378 wt % of the average to −1.615 wt %. The spread in disk weights decreased as more castings were made. Subsequent disk casting data are shown in Table XII. These eight disks contained 5.46 g of americium and the average disk weight was 6.04726. The spread in disk weights varied from +0.72 wt % to −0.80 wt %.

Another disk set containing 21.34 g of Am was prepared using these procedures and using an alloy of Table III above containing 20% of Am.

TABLE XI

DISK DIMENSION AND WEIGHT DATA FROM EARLY CERIUM-AMERICIUM ALLOY CASTING

| Disk No. | Disk Weights and Dimensions: Diameter, Inch Min. | Max. | Thickness, Inch Min. | Max. | Weight, Grams |
|---|---|---|---|---|---|
| 1 | 0.8613 | 0.8653 | 0.1692 | 0.1712 | 12.2325 g |
| 2 | 0.8602 | 0.8640 | 0.1683 | 0.1691 | 12.1341 g |
| 3 | 0.8632 | 0.8686 | 0.1678 | 0.1687 | 12.1026 g |
| 4 | 0.8624 | 0.8636 | 0.1674 | 0.1689 | 11.8713 g |
| 5 | 0.8590 | 0.8600 | 0.1677 | 0.1683 | 11.9628 g |
| 6 | 0.8591 | 0.8600 | 0.1674 | 0.1683 | 12.0285 g |
| 7 | 0.8607 | 0.8693 | 0.1683 | 0.1687 | 12.0840 g |
| 8 | 0.8595 | 0.8607 | 0.1690 | 0.1696 | 12.1134 g |
| | | | | TOTAL | 96.5292 g |

Average Wt. = 12.06615 g, percent weight spread +1.378, −1.615
Total americium content of disks 21.18 g

TABLE XII

DISK WEIGHT DATA FROM LATER CERIUM-AMERICIUM ALLOY CASTING

| Disk No. | Disk Weight, Grams |
|---|---|
| 1 | 6.0176 |
| 2 | 6.0832 |
| 3 | 6.0590 |
| 4 | 6.0636 |
| 5 | 6.0368 |
| 6 | 5.9988 |
| 7 | 6.0909 |
| 8 | 6.0282 |
| TOTAL | 48.3781 |

Average Wt. = 6.04726 g, percent weight spread +0.72, −0.80
Total americium content of disks 5.46 g

EXAMPLE 9

The same basic procedures described in the foregoing examples with respect to cerium/americium alloys are employed to prepare corresponding alloys of cerium/curium cerium/berkelium and cerium/californium. The only changes to be made are those which are derived from the known differences in the physical and chemical properties of the mentioned three transplutonium elements with respect to the corresponding physical and chemical properties of americium. These differences are well known to those skilled in the art and the necessary changes in the foregoing detailed examples are also readily apparent to those skilled in the art or can be determined by routine preliminary experiments.

The preceding examples can be repeated with similar success by substituting the generically or specifically described reactants and/or operating conditions of this invention for those used in the preceding examples. From the foregoing description, one skilled in the art can easily ascertain the essential characteristics of this invention, and without departing from the spirit and scope thereof, can make various changes and modifications of the invention to adapt it to various usages and conditions.

What is claimed is:

1. An alloy consisting essentially of 1 to 99 wt % of Ce and 99 to 1 wt % of Am, Cm, Bk or Cf.

2. An alloy of claim 1, consisting essentially of 1 to 99 wt % of Ce and 99 to 1 wt % of Am.

3. An alloy of claim 2, consisting essentially of 1 to 99 wt % of Ce and 99 to 1 wt % of Cm.

4. An alloy of claim 1, consisting essentially of 90–75 wt % of Ce and 10–25 wt % of Am, Cm, Bk or Cf.

5. An alloy of claim 3, consisting essentially of 90–75 wt % of Ce and 10–25 wt % of Am.

6. An alloy of claim 3, consisting essentially of 90–75 wt % of Ce and 10–25 wt % of Cm.

7. An alloy of claim 1, consisting essentially of 95–50 wt % of Ce and 5–50 wt % of Am, Cm, Bk or Cf.

8. An alloy of claim 3, consisting essentially of 95–50 wt % of Ce and 5–50 wt % of Am.

9. An alloy of claim 3, consisting essentially of 95–50 wt % of Ce and 5–50 wt % of Cm.

10. An alloy of claim 5, wherein the Am isotope is Am-241.

11. An alloy of claim 6, wherein the Cm isotope is Cm-244.

12. In a radiation detector comprising an active cell containing a radioactive actinide composition, the improvement wherein the radioactive composition is an alloy of claim 4, 5 or 6.

13. A method for preparing an alloy of claim 1, containing at least 25 wt % of Ce, comprising comelting cerium metal and one of said transplutonium metals at a temperature which is above the melting point of cerium, below the melting point of the transplutonium metal and above the melting point of the alloy which is prepared, such that essentially no vaporization of the transplutonium metal occurs.

14. A method of claim 13, wherein the transplutionium metal is Am and the amount of Ce is at least 50 wt %.

* * * * *